US006373368B1

(12) United States Patent
Shikama et al.

(10) Patent No.: US 6,373,368 B1
(45) Date of Patent: Apr. 16, 2002

(54) INDUCTOR AND MANUFACTURING METHOD THEREOF

(75) Inventors: Takashi Shikama, Yokaichi; Iwao Fukutani; Junichi Hamatani, both of Shiga-ken; Kenichi Saito, Fukui-ken; Hisato Oshima, Takefu, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/665,243

(22) Filed: Sep. 18, 2000

(30) Foreign Application Priority Data

Sep. 16, 1999 (JP) ..... 11-261472
Jul. 28, 2000 (JP) ..... 2000-229511

(51) Int. Cl.[7] ..... H01F 5/00
(52) U.S. Cl. ..... 336/200; 29/605
(58) Field of Search ..... 336/200, 232, 336/220, 84, 90, 96; 29/605

(56) References Cited

U.S. PATENT DOCUMENTS 4,797,648 A * 1/1989 Kaneko et al. ..... 336/192
6,144,280 A * 11/2000 Amada et al. ..... 336/192

FOREIGN PATENT DOCUMENTS

JP 4-42906 * 2/1992

* cited by examiner

*Primary Examiner*—Lincoln Donovan
(74) *Attorney, Agent, or Firm*—Keating & Bennett, LLP

(57) ABSTRACT

A method for efficiently and economically manufacturing an inductor using a resin based magnetic material, and a highly reliable inductor that is manufactured by the method, produces a unique inductor including a molded magnetic material member. An inner conductor is disposed in the molded magnetic material member and is exposed at a surface of the molded magnetic material member. The molded magnetic material member is formed using the resin based magnetic material in which a component that functions as nuclei for applying electroless plating is blended, followed by forming a selectively coated molded body so that the area not provided with external electrodes on the surface of the molded magnetic material member is covered with an insulating resin and applying electroless plating on the molded magnetic material member (selectively coated molded body), thereby eliminating use of a resist agent that is required in the conventional manufacturing method, as well as a resist agent removing step with an alkali and solvent and a removing step of the electroless plating film with an acid, by forming the electroless plating film as the external electrodes on the desired area.

13 Claims, 7 Drawing Sheets

INDUCTOR AND MANUFACTURING METHOD THEREOF

BACKGROUND OF THE INVENTION

1. Field of the Invention

The present invention relates to an inductor and a method for manufacturing thereof. More particularly, the present invention relates to an inductor having external electrodes disposed at a certain position on a molded magnetic material member so as to be electrically connected to inner electrodes embedded within a molded magnetic material member.

2. Description of the Related Art

As shown in FIG. 12, a surface mounting type inductor includes a coil (an inner conductor) 52 that functions as an inductance element embedded in a resin based magnetic material 51 made by blending a magnetic powder and a resin to produce a molded magnetic material member 53 having at two terminal surfaces, terminals 52*a* and 52*b* of the coil 52 which are exposed, and a pair of external electrodes 54*a* and 54*b* are arranged to be electrically connected to the terminals 52*a* and 52*b* of the coil 52.

This inductor may be manufactured by providing the external electrodes 54*a* and 54*b* on the molded magnetic material member 53 made by molding the resin based magnetic material 51 produced by blending a magnetic power and a resin. This inductor requires no firing process at a high temperature as has been required in ceramic inductors using conventional magnetic ceramics, thus facilitating the manufacture of the inductor.

The inductor using the resin based magnetic material as described above is manufactured, for example, by the following steps.

(1) Preparing a ferrite powder (a magnetic powder), ferrite-resin pellets (a magnetic material) prepared by kneading the ferrite powder with a resin, and a coil (an inner conductor) produced by molding a copper wire (an AIW wire) coated with an insulating resin (a polyamide-imide resin) into a coil.

(2) Then, a ferrite-resin molded body (a molded magnetic material member) 53 is formed, wherein the coil (the inner conductor) 52 that functions as an inductor element is embedded within the magnetic material 51 as shown in FIG. 6 by injection molding of the ferrite containing resin around the coil after allowing the ferrite-resin pellets to melt by heating.

(3) Subsequently, sand-blasting is performed on the area (the both terminal surfaces of the molded magnetic material member 53) on which external electrodes 54*a* and 54*b* (see FIG. 12) are to be provided on the surface of the molded magnetic material member 53 as shown in FIG. 7 to expose both terminals 52*a* and 52*b* (see FIG. 12) of the coil 52 from the molded magnetic material member 53, and removing an insulating coating film (a polyamide imide resin) on the coil 52.

(4) Subsequently, a Ni electroless plating is applied after applying a nucleation treatment for the electroless plating on the molded magnetic material member 53, and a Ni electroless plating film 55 is formed on the entire surface of the molded magnetic material member 53 as shown in FIG. 8.

(5) In the next step, a resist agent 56 is coated on the area as shown in FIG. 9 where the external electrodes 54*a* and 54*b* (see FIG. 12) are to be provided on the molded magnetic material member 53, the entire surface of which is covered with the Ni electroless plating film, and the resist film is dried.

(6) Then, the Ni electroless plating film 55 at the unnecessary portion on the surface of the molded magnetic material member 53 is removed by etching with an acid as shown in FIG. 10.

(7) Subsequently, the resist agent 56 is removed with an alkali (FIG. 11).

(8) Then, a Ni electroplating film 57 is formed on the Ni electroless plating film 55 as shown in FIG. 12 by applying a Ni electroplating on the molded magnetic material member 53. Finally, a Sn electroplating film 58 is further formed on the plating films 55 to form the three layered external electrodes 54*a* and 54*b* including the Ni electroless plating film 55, the Ni electroplating film 57, and the Sn electroplating film 58.

In the process for manufacturing the inductor using the foregoing resin-based magnetic material, the Ni electroless plating film 55 is provided on the entire surface of the molded magnetic material member 53, and the resist agent 56 is coated on the area where the external electrodes 54*a* and 54*b* (FIG. 12) are to be provided, followed by removing the resist agent 56 with an alkali after removing the unnecessary Ni electroless plating film 55 by etching with an acid. Consequently, the manufacturing process involves many steps thus complicating the process, as well as increasing the manufacturing costs. Moreover, the process requires a lot of labor to process unnecessary products generated in the etching step using an acid for removing the unnecessary portion of the Ni electroless plating film, and the step for removing the resist agent using an alkali.

SUMMARY OF THE INVENTION

To overcome the above-described problems, preferred embodiments of the present invention provide a method for efficiently manufacturing an inductor using a resin-based magnetic material, and further provide a reliable inductor at greatly reduced costs.

A first preferred embodiment of the present invention provides a method for manufacturing an inductor including the steps of molding a magnetic material prepared by blending a magnetic powder with a resin into a molded body having a desired shape so that an inner conductor that functions as an inductance element is embedded within the molded body, thereby forming a molded magnetic material member having a portion of the inner conductor exposed on a surface thereof, forming a selectively coated molded body (a molded body having a main portion that is selectively coated with an insulating resin) so that the areas on the surface of the molded magnetic material member except for the area to be provided with external electrodes is coated with the insulating resin, and forming the external electrodes including an electroless plating film on the area to be provided with the external electrodes (the area where the insulating resin is not coated) by applying electroless plating on the selectively coated molded body such that the external electrodes are electrically connected to the inner conductor.

In the method for manufacturing the inductor described above, after forming the molded magnetic material member, having the portion of the inner conductor exposed at a surface thereof, by using a resin based magnetic material, the selectively coated molded body is formed so that the area not provided with the external electrodes on the surface of the molded magnetic material member is covered with the insulating resin. The external electrodes are formed at desired areas by applying electroless plating film on the molded magnetic material member (the selectively coated molded body).

Consequently, a resist agent used in conventional manufacturing methods is not required in the present invention. As a result, the steps for removing the resist agent with an alkali or a solvent (simply referred as a liquid chemical hereinafter) and the steps for removing the electroless plating films by etching with acid are eliminated. Therefore, the manufacturing process of preferred embodiments of the present invention is greatly simplified and greatly reduces the manufacturing costs and the labor involved in manufacturing.

A second preferred embodiment of the present invention provides a method for manufacturing an inductor including the steps of molding a magnetic material prepared by blending a magnetic powder, a resin and a component functioning as nuclei for applying electroless plating into a molded body having a prescribed shape so that an inner conductor that functions as an inductance element is embedded within the molded body, thereby forming a molded magnetic material member having a portion of the inner conductor exposed on a surface thereof, forming a selectively coated molded body so that the area on the surface of the molded magnetic material member except for the area to be provided with external electrodes is coated with an insulating resin, and forming the external electrodes including an electroless plating film on the area to be provided with the external electrodes by applying electroless plating on the selectively coated molded body.

Since the resin based magnetic material prepared by blending a component that functions as nuclei for applying electroless plating is used in the method for manufacturing the inductor described above, electroless plating may be more efficiently applied on the surface of the molded magnetic material member than using a magnetic material prepared by merely blending a magnetic material with a resin.

The same advantages as the first preferred embodiment of the present invention are achieved in the second preferred embodiment of the present invention.

Preferably, the external electrodes are formed by applying electroless plating after roughening the area to be provided with the external electrodes on the molded magnetic material member by a blast medium blow method.

When electroless plating is applied after roughening the areas to be provided with the external electrodes on the surface of the molded magnetic material member by a blast medium blowing method (powder granules), an electroless plating film with a greatly improved adhesive property is formed on the surface of the molded magnetic material member. The blast medium blowing method is performed because the surface of the molded magnetic material member tends to provide insufficient adhesive strength with the electroless plating film.

The blast medium method (powder granules) for roughening the surface includes, for example, a dry blast method (a sand blast method) in which the surface of the molded magnetic material member is roughened by blowing a blast medium such as alumina powder and silica powder together with air, and a wet blast method in which the surface of the molded magnetic material member is roughened by spraying a blast medium such as alumina powder and silica powder together with a liquid, such as water.

The step for roughening the surface by the blast medium blowing method may be preformed before or after the step for coating the area not provided with the external electrodes with an insulating resin.

A third preferred embodiment of the present invention provides a method for manufacturing an inductor including the steps of molding a magnetic material prepared by blending a magnetic powder with a resin into a molded body having desired shape so that an inner conductor that functions as an inductance element is embedded within the molded body, thereby forming a molded magnetic material member having a portion of the inner conductor exposed on a surface thereof, coating the entire surface of the molded magnetic material member with an insulating resin, eliminating the insulating resin coating the area to be provided with the external electrodes on the surface of the molded magnetic material member by a blast medium blowing method, followed by roughening the exposed surface of the molded magnetic material member, and forming the external electrodes made of an electroless plating film on the area to be provided with the external electrodes by applying electroless plating on the molded magnetic material member.

The entire surface of the molded magnetic material member prepared by molding the resin based magnetic material is coated with the insulating resin, and the insulating resin on the area to be provided with the external electrodes is eliminated by a blast medium blowing method such as a sand blast method. The external electrodes made by the electroless plating films are formed on the area which is not coated with the insulating resin, by applying electroless plating on the molded magnetic material member after roughening the exposed surface on the molded magnetic material member.

Consequently, a resist agent that is required in the conventional manufacturing methods is not required in preferred embodiments of the present invention, and the steps for removing the resist agent with a liquid chemical, and the steps for removing the electroless plating films by etching with an acid are also eliminated. Accordingly, the manufacturing process is greatly simplified to greatly reduce the manufacturing costs and the labor required.

A fourth preferred embodiment of the present invention provides a method for manufacturing an inductor including the steps of molding a magnetic material prepared by blending a magnetic powder, a resin and a component that functions as nuclei for applying electroless plating into a molded body having a prescribed shape such that an inner conductor that functions as an inductance element is embedded within the molded body, thereby forming a molded magnetic material member having a portion of the inner conductor exposed on a surface thereof, coating the entire surface of the molded magnetic material member with an insulating resin, removing the insulating resin coating the area to be provided with the external electrodes on the surface of the molded magnetic material member by a blast medium blowing method, followed by roughening the exposed surface of the molded magnetic material member, and forming the external electrodes including an electroless plating film on the area to be provided with the external electrodes by applying electroless plating on the molded magnetic material member.

Since the resin based magnetic material member prepared by blending a component that functions as nuclei for applying electroless plating is used in the method for manufacturing the inductor described above, electroless plating is more efficiently applied on the surface of the molded magnetic material member than using a magnetic material prepared by merely blending a magnetic material with a resin.

The same advantages of the third preferred embodiment of the present invention are achieved in the fourth preferred embodiment of the present invention.

The external electrodes including an electroless plating film are provided on both end surfaces of the molded magnetic material member and on the portions extending from the both end surfaces to the outer circumferential surface thereof by applying electroless plating, after eliminating the insulating resin and roughening the exposed surface of the molded magnetic material member on both end surfaces of the molded magnetic material member and on the portions extending from the both end surfaces to the outer circumference surface thereof by the blast medium blowing method.

When the external electrodes are provided on both end surfaces of the molded magnetic material member and on the portions extending from the both end surfaces to the outer circumference surfaces by applying electroless plating, after roughening the both end surfaces of the molded magnetic material member and the portions extending from the both end surfaces to the outer circumference surfaces, inductors which are suitable for surface mounting and which have highly reliable electrical connections are efficiently manufactured when the inductors are mounted by, for example, a reflow soldering method or other suitable method.

Pd may be used for the component to function as nuclei for applying electroless plating.

When Pd is blended with the resin based magnetic material member as a component that functions as nuclei in applying electroless plating, an electroless plating film having outstanding adhesive strength is produced on the surface of the magnetic material member.

Preferably, the electroless plating films include a plurality of layers formed by applying different types of electroless plating in a plurality of steps.

Since the electroless plating includes a plurality of layers formed by applying different types of electroless plating in a plurality of steps in preferred embodiments of the present invention, electrodes having desired characteristics are provided.

Preferably, the method of manufacturing the inductor further includes a step of forming an external electrode including an upper electrolytic plating film with a monolayer or multilayer structure by additionally applying one or more types of electrolytic plating on the external electrodes including the electroless plating films.

Applying one or more types of electrolytic plating on the external electrode including the electroless plating film produces an external electrode having an upper layer electrolytic plating film on the electroless plating film, thereby providing an inductor having external electrodes with greatly improved reliability in electrical connection and soldering properties.

A fifth preferred embodiment of the present invention provides an inductor including an inner conductor that functions as an inductance element embedded within a molded magnetic material member made by molding a magnetic material prepared by blending a magnetic powder with a resin, and external electrodes with a monolayer or multilayer structure including at least electroless plating film layers formed on a roughened area on the surface of the molded magnetic material member, wherein the area not provided with the external electrodes on the surface of the molded magnetic material member is coated with an insulating resin.

The inductor described above has outstanding adhesive properties and a highly reliable electrical connection because the external electrode is formed on the roughened area on the surface of the molded magnetic material member formed by molding the resin type magnetic material. The inductor according to preferred embodiments of the present invention is efficiently manufactured by applying the aspects and other features of the present invention.

A sixth preferred embodiment of the present invention provides an inductor including an inner conductor that functions as an inductor element embedded within a molded magnetic material member formed by molding a magnetic material prepared by blending a magnetic powder, a resin and a component that functions as nuclei for applying electroless plating, and external electrodes with a monolayer or multilayer structure including at least one electroless plating layer formed on a roughened area on the surface of the molded magnetic material member, wherein the area not provided with the external electrodes on the surface of the molded magnetic material member is coated with an insulating resin.

Since the external electrodes are formed on the roughened area on the surface of the molded magnetic material member, the inductor has outstanding adhesive properties on the surface of the molded magnetic material member and a highly reliable electrical connection. The inductor is also efficiently manufactured by applying these and other aspects according to preferred embodiments of the present invention.

Other features, characteristics, elements and advantages of the present invention will become apparent from the following description of preferred embodiments thereof with reference to the attached drawings.

DETAILED DESCRIPTION OF PREFERRED EMBODIMENTS

The features of the present invention will be described in more detail with reference to the preferred embodiments of the present invention.

FIGS. 1 to 5 show a method for manufacturing an inductor according to a preferred embodiment of the present invention.

Figure 5:
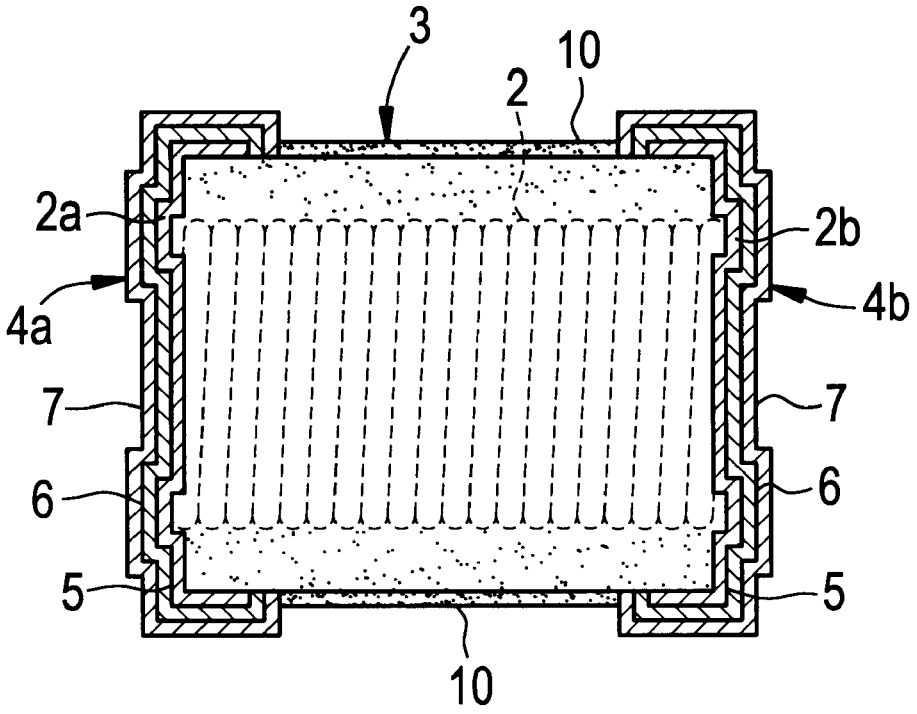
FIG. 5 shows an inductor manufactured by the method for forming the inductor according to a preferred embodiment of the present invention.
Figure 6:
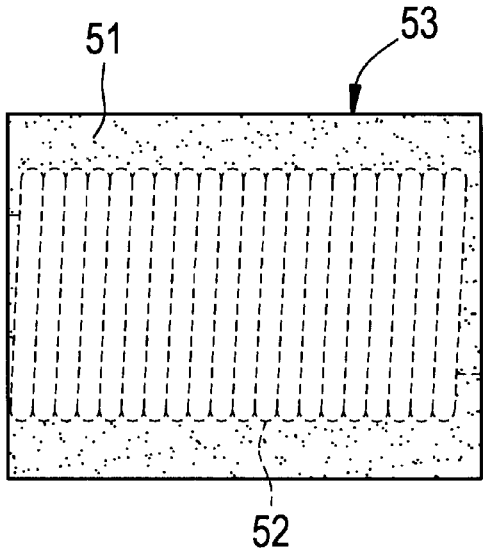
FIG. 6 shows the method for manufacturing the conventional inductor, wherein the molded magnetic material member is formed in one step of the method.
Figure 7:
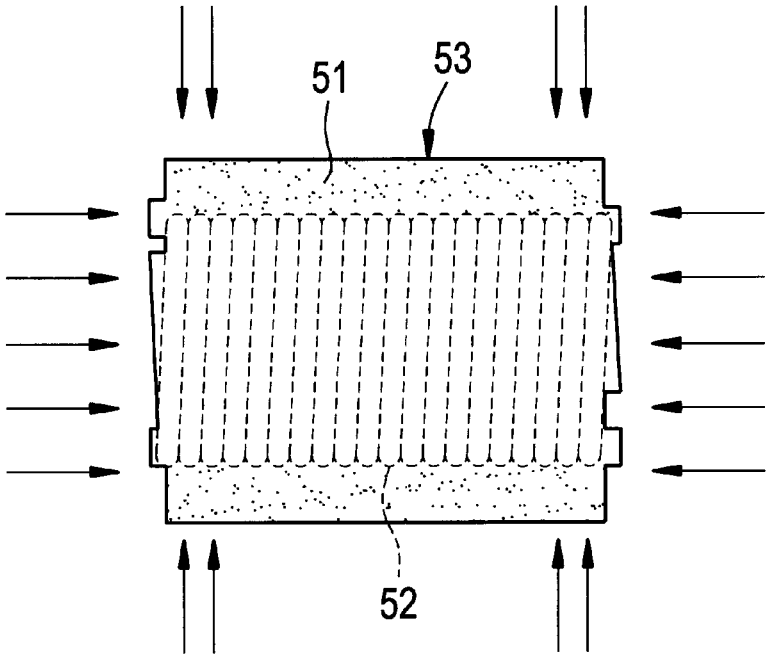
FIG. 7 shows the method for manufacturing the conventional inductor, wherein a sand blast process is performed on both terminals of the molded magnetic material member in one step of the manufacturing method.
Figure 8:
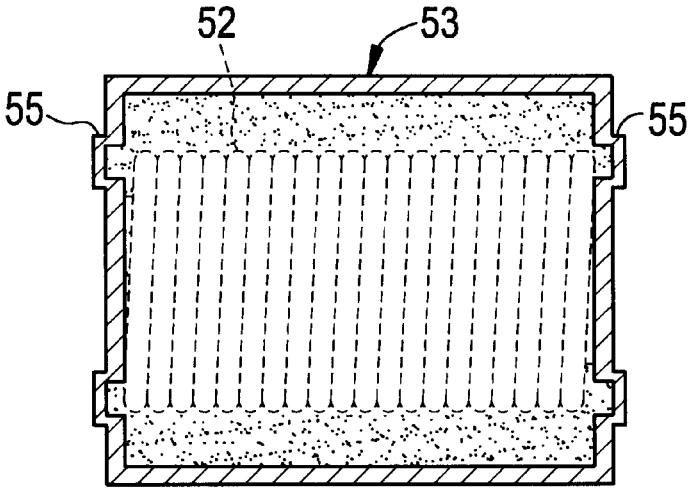
FIG. 8 shows a method for manufacturing a conventional inductor, wherein electroless plating is applied on the entire surface of the molded magnetic material member in one step of the manufacturing method.
Figure 9:
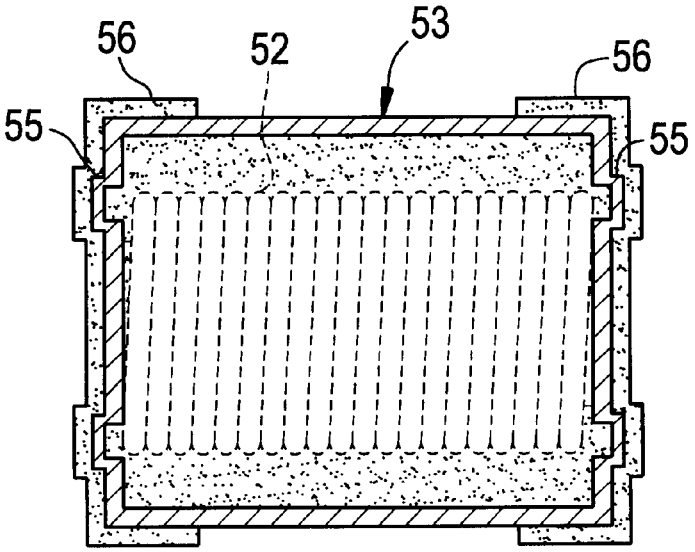
FIG. 9 shows a method for manufacturing a conventional inductor, wherein a resist agent is coated on both terminals of the molded magnetic material member in one step of the manufacturing method.
Figure 10:
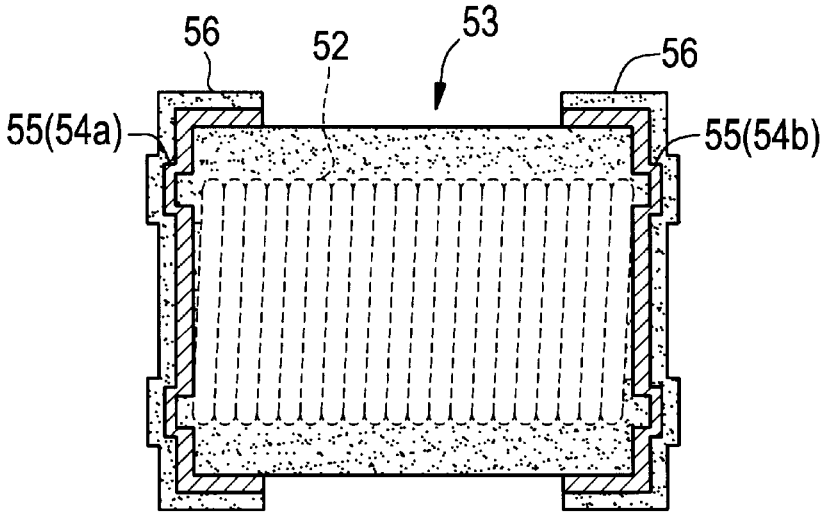
FIG. 10 shows a method for manufacturing a conventional inductor, wherein the unnecessary portions of the electroless plating film on the surface of the molded magnetic material member are removed in one step of the manufacturing method.
Figure 11:
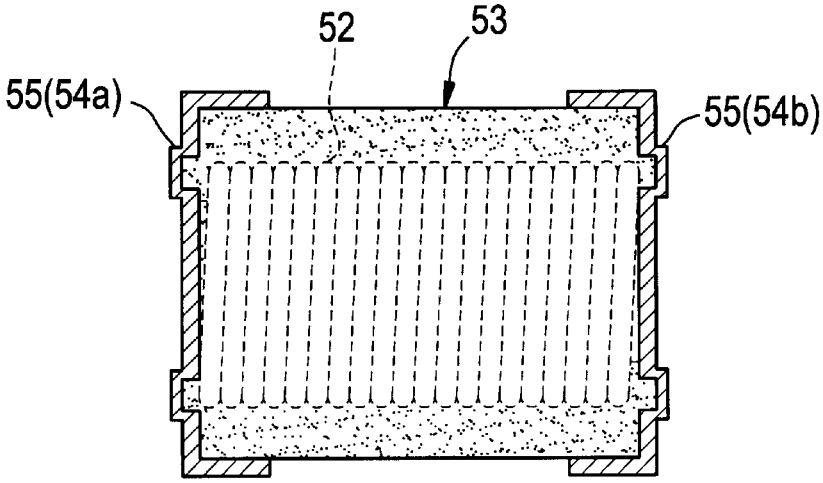
FIG. 11 shows a method for manufacturing a conventional inductor, wherein the resist agent is removed in one step of the manufacturing method.
Figure 12:
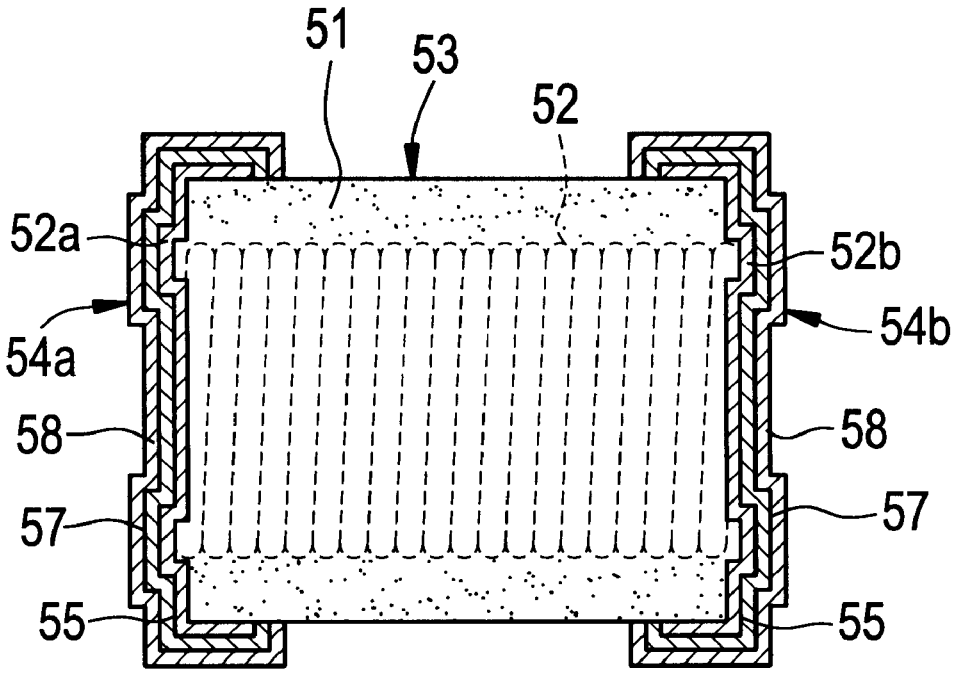
FIG. 12 shows an inductor manufactured by a method for manufacturing a conventional inductor.

The method for manufacturing a surface mounting type inductor according to this preferred embodiment will be described hereinafter, wherein the external electrodes 4*a* and 4*b* are electrically connected to terminals 2*a* and 2*b* of a coil 2 and disposed at terminal portions of a molded magnetic material member 3 such that the coil (the inner conductor) 2 functions as an inductance element and is embedded as shown in FIG. 5, and the portion not provided with the external electrodes 4*a* and 4*b* is coated with an insulating resin 10.

The method according to this preferred embodiment includes preparing ferrite-resin pellets (magnetic material) obtained by kneading a ferrite powder (magnetic powder) including $Fe_2O_3$, NiO, CuO and ZnO, a polyphenylene sulfide (PPS) resin, and a component (Pd in this preferred embodiment) that functions as nuclei for applying electroless plating, and a coil (an inner conductor) and providing a copper wire(an AIW wire) coated with a polyamidoimide resin in a coil shape.

Figure 1:
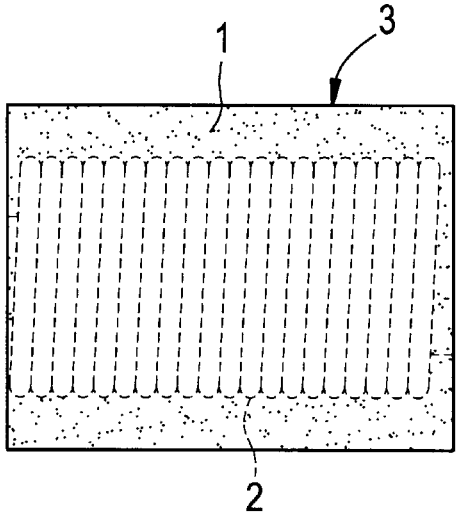
FIG. 1 shows a molded magnetic material member formed in on step in the method for manufacturing the inductor according to a preferred embodiment of the present invention.

Then, a molded ferrite resin (a molded magnetic material member) 3 preferably having approximate dimensions of 4.5 mm×3.2 mm×3.2 mm, in which a coil (an inner conductor) 2 that functions as an inductance element is embedded within a magnetic material 1, is formed as shown in FIG. 1 by injection molding the ferrite resin around the coil after heat melting of the ferrite resin pellets.

Figure 2:
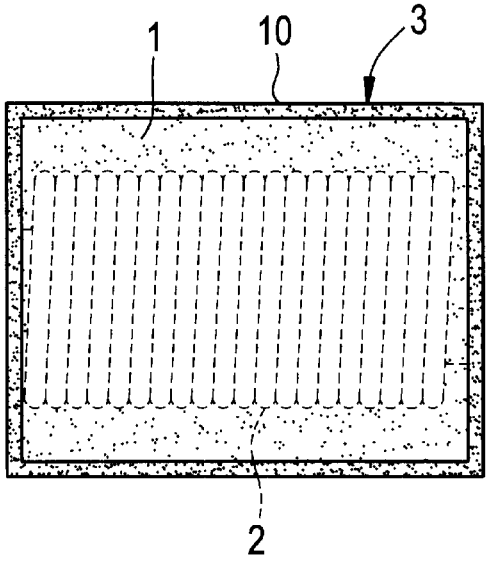
FIG. 2 shows the molded magnetic material member with the entire surface covered with an insulation resin in one step in the method for manufacturing the inductor according to a preferred embodiment of the present invention.
Figure 3:
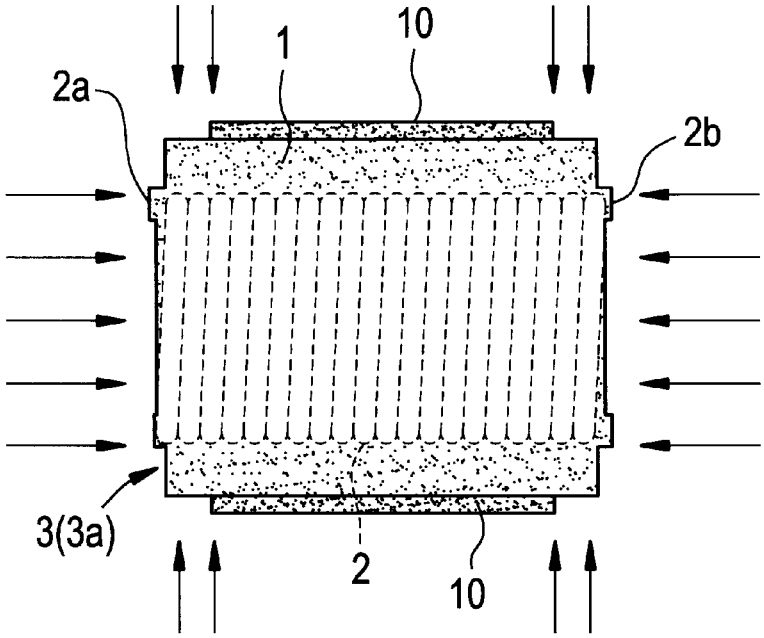
FIG. 3 shows the surface of the molded magnetic material member where a sand blast process is performed on the area to be provided with the external electrodes in one step in the method for manufacturing the inductor according to one preferred embodiment of the present invention.

Then, the surface of the molded magnetic material member 3 is coated with an insulating resin 10 by a resin impregnation method as shown in FIG. 2. An epoxy resin is used as the insulating resin 10 in this preferred embodiment.

Next, a sand blast process is performed on the area (the area on the both end surfaces of the molded magnetic material member 3 and the area extending from the both end surfaces to the outer circumference surface) to be provided with external electrodes 4*a* and 4*b* (FIG. 5). The terminals 2*a* and 2*b* of the coil 2 are exposed from the molded magnetic material member 3 by removing the insulating resin 10, followed by removing the insulating film (the polyamidoimide resin) of the coil 2 and roughening the area to be provided with the external electrodes 4*a* and 4*b* (FIG. 5) on the surface of the molded magnetic material member 3. A selectively coated molded body 3 (3*a*) is thereby formed, wherein the surface portions of the molded magnetic material member 3 except for the region to be provided with the external electrodes 4*a* and 4*b* (FIG. 5) is coated with the insulating resin 10.

Figure 4:
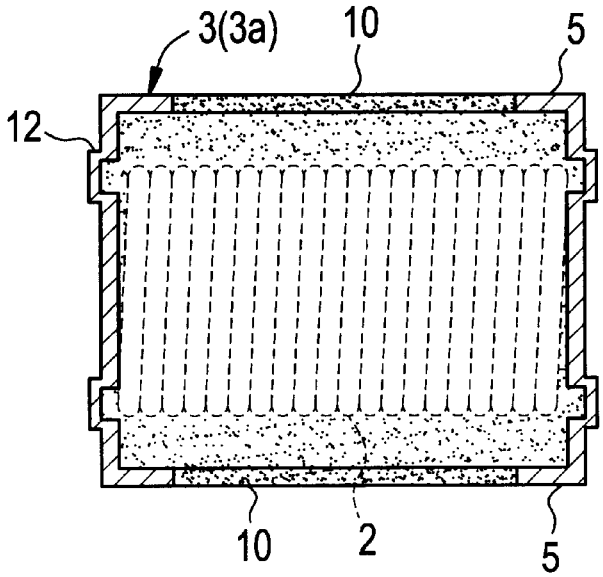
FIG. 4 shows the surface of the molded magnetic material member where electroless plating is applied on the area to be provided with the external electrodes in one step in the method for manufacturing the inductor according to a preferred embodiment of the present invention.

Then, Ni electroless plating is applied on the selectively coated molded body 3 (3*a*), and a Ni electroless plating film 5 is applied to the exposed surface not covered with the insulating resin 10 at both terminals of the molded magnetic material member 3 as shown in FIG. 4. No electroless plating films are applied on the surface of the insulating resin 10 because the component that functions as nuclei for applying electroless plating is not coated on the insulating resin 10.

The thickness of the Ni electroless plating film is about 2 μm in this preferred embodiment. However, the thickness of the Ni electroless plating film can be adjusted to about 0.5 μm or more in order to form the Ni electroless plating film having no film gaps.

Finally, the molded magnetic material member 3 is placed in a barrel to apply Ni electrolytic plating to form a Ni electrolytic plating film 6 on the Ni electroless plating film 5 as shown in FIG. 5, followed by additionally applying a Sn electrolytic plating film 7 thereon. A surface mount type inductor is thus produced, wherein the external electrodes 4*a* and 4*b* having three layers of the Ni electroless plating film 5, the Ni electrolytic plating film 6 and the Sn electrolytic plating film 7 are provided at both end surfaces of the molded magnetic material member 3.

According to the manufacturing method of this preferred embodiment, electroless plating is efficiently applied on the surface of the molded magnetic material member since a resin based magnetic material, in which a component that functions as nuclei for applying electroless plating is blended, is used. Since the manufacturing method involves no resist coating step, a step for removing the resist agent using an alkali or a solvent, as well as a step for removing unnecessary portions on the electrodes (the electroless plating films) by etching with an acid, are omitted, and thus manufacturing efficiency is greatly improved.

Since the external electrodes are provided on both end surfaces and on the area extending from both end surfaces to the outer circumferential surfaces in the preferred embodiment described above, an inductor having a high mounting reliability on a circuit board is efficiently manufactured.

However, the area or the pattern for forming the external electrodes are not limited to those described above, but the external electrodes may be formed only on both end surfaces of the molded magnetic material member, or other suitable patterns.

While Pd is used in the magnetic material as the component that functions as nuclei for applying electroless plating in this preferred embodiment, other suitable substances may also be used.

The molded magnetic material member may also be formed using a resin based magnetic material in which no substance that functions as nuclei for applying electroless plating is blended in various preferred embodiments of the present invention, by appropriately selecting the kinds of the magnetic powder and resin to be used.

While epoxy resins are used for the insulating resin in the preferred embodiment described above, various other insulation resins such as polyamide resins, polyester resins and phenol resins may be used as alternatives.

According to the method of preferred embodiments described above, no drying steps are required between the electroless plating step and electroplating step, and the plating steps are continuously performed in the barrel, which is particularly advantageous when an electroplating step is required after an electroless plating step.

It should be understood that the present invention is not restricted to preferred embodiments described above, but various applications and modifications are contemplated within the scope of the present invention with respect to the other procedures including the kinds of the magnetic powder and resin constituting the magnetic material, actual configurations of the molded magnetic material member, materials and configurations of the external electrode and inner conductor (coil), actual conditions of electroless plating, the kind of the electroless plating film, and actual conditions of roughening by the blast medium blowing method.

What is claimed is:

1. A method for manufacturing an inductor comprising the steps of:

molding a magnetic material prepared by blending a magnetic powder with a resin into a molded body having a desired shape such that an inner conductor defining an inductance element is embedded within the molded body, thereby forming a molded magnetic material member having a portion of the inner conductor exposed at a surface thereof;

forming a resin-coated molded body having a main portion which is selectively coated with an insulating resin such that the insulating resin is coated on an entire surface of the molded magnetic material member except in a region where external electrodes are to be provided; and forming the external electrodes including electroless plating films on the region where the external electrodes are to be formed by applying electroless plating on the resin-coated molded body.

2. A method for manufacturing an inductor according to claim 1, wherein said step of forming the external electrodes includes the step of applying multiple electroless plating films.

3. A method for manufacturing an inductor according to claim 2, wherein at least one of said multiple electroless plating films is a Ni film.

4. A method for manufacturing an inductor according to claim 2, wherein at least one of said multiple electroless plating films is an Sn film.

5. A method for manufacturing an inductor according to claim 1, wherein the external electrodes are formed by applying electroless plating after roughening the area to be provided with the external electrodes on the molded magnetic material member by a blast medium blow method for blowing a blast medium.

6. A method for manufacturing an inductor according to claim 1, wherein said electroless plating films define a structure including a plurality of layers which are formed by applying different kinds of electroless plating a plurality of times.

7. A method for manufacturing an inductor according to claim 1, further comprising a step of forming an external electrode including an upper electrolytic plating film with a monolayer or multilayer structure by additionally applying at least one type of electrolytic plating on said external electrodes.

8. A method for manufacturing an inductor comprising the steps of:

molding a magnetic material prepared by blending a magnetic powder, a resin and a component to function as nuclei for applying electroless plating into a molded body having a desired shape so that an inner conductor functioning as an inductance element is embedded within the molded body, thereby forming a molded magnetic material member having a surface at which a portion of the inner conductor is exposed;

forming a selectively coated molded body so that an area outside of an area to be provided with external electrodes on the surface of the molded magnetic material member is coated with an insulating resin; and forming the external electrodes including electroless plating films on the area to be provided with the external electrodes by applying electroless plating on the selectively coated molded body.

9. A method for manufacturing an inductor according to claim 8, wherein the external electrodes are formed by applying electroless plating after roughening the area to be provided with the external electrodes on the molded magnetic material member by a blast medium blow method for blowing a blast medium.

10. A method for manufacturing an inductor according to claim 8, wherein said step of forming the external electrodes includes the step of applying multiple electroless plating films.

11. A method for manufacturing an inductor according to claim 10, wherein at least one of said multiple electroless plating films is a Ni film.

12. A method for manufacturing an inductor according to claim 10, wherein at least one of said multiple electroless plating films is an Sn film.

13. A method for manufacturing an inductor according to claim 8, wherein Pd is used for the component to function as nuclei for applying electroless plating.

* * * * *